US005875716A

United States Patent [19]

Scheuhing

[11] Patent Number: 5,875,716

[45] **Date of Patent: *Mar. 2, 1999**

[54] ROTATING INK CUP

[75] Inventor: Robert B. Scheuhing, Rindge, N.H.

[73] Assignee: Markem Corporation, Keene, N.H.

[ * ] Notice: This patent issued on a continued prosecution application filed under 37 CFR 1.53(d), and is subject to the twenty year patent term provisions of 35 U.S.C. 154(a)(2).

[21] Appl. No.: 907,684

[22] Filed: Aug. 8, 1997

Related U.S. Application Data

[63] Continuation of Ser. No. 760,856, Dec. 5, 1996, abandoned.

[51] Int. Cl.[6] ..... B41F 31/00

[52] U.S. Cl. ..... 101/335; 101/170

[58] Field of Search ..... 101/335, 163, 101/318, 364, 170

[56] References Cited

U.S. PATENT DOCUMENTS

| | | | |
|---|---|---|---|
| 5,003,872 | 4/1991 | Dalferth | 101/163 |
| 5,363,761 | 11/1994 | Galassi | 101/163 |
| 5,367,953 | 11/1994 | Yamashita et al. | 101/158 |
| 5,392,706 | 2/1995 | Drew et al. | 101/170 |
| 5,419,247 | 5/1995 | Bachmann | 101/318 |
| 5,476,040 | 12/1995 | Kleist | 101/163 |
| 5,578,364 | 11/1996 | Drew et al. | 101/163 |
| 5,662,041 | 9/1997 | Kleist | 101/163 |
| 5,669,301 | 9/1997 | Bachmann et al. | 101/163 |
| 5,694,847 | 12/1997 | Kleist | 101/170 |

FOREIGN PATENT DOCUMENTS

| | | | |
|---|---|---|---|
| 09100288 | 1/1993 | Belgium . | |
| 0 712 724 A1 | 5/1996 | European Pat. Off. . | |
| A-43 16 294 | 11/1993 | Germany . | |
| 0225347 | 10/1987 | Japan | 101/163 |
| WO 93/11943 | 6/1993 | WIPO . | |

OTHER PUBLICATIONS

PCT search Report, PCT/US97/22553, dated Feb. 23, 1998.

*Primary Examiner*—Edgar Burr
*Assistant Examiner*—Anthony H. Nguyen
*Attorney, Agent, or Firm*—Fish & Richardson P.C.

[57] ABSTRACT

A cup holder for rotating a doctoring ink cup includes a housing with a cup receiving chamber and a bumper extending into the chamber. The bumper contacts the ink cup to rotate it within the chamber during inking of a gravure plate. It is the relative motion of the plate and the ink cup during inking of the plate which causes the bumper to contact the ink cup. A second bumper extends into the cup receiving chamber. A method of inking a gravure plate includes inking the plate by relative motion between an ink cup and the plate, and rotating the ink cup during inking such that an edge of the ink cup in contact with the plate rotates with respect to the plate. The rotation is caused by the relative motion.

9 Claims, 4 Drawing Sheets

ROTATING INK CUP

This is a continuation of application Ser. No. 08/760,856, filed Dec. 5, 1996, now abandoned.

BACKGROUND OF THE INVENTION

The invention relates to ink cups for doctoring gravure printing plates.

A pad printing machine includes an ink cup supported in an inverted position and in contact with a gravure printing plate mounted for reciprocal motion below the ink cup to transfer ink to a printing pad. The ink cup includes a plate contacting edge which serves as a sliding seal between the ink cup and the gravure printing plate and as a doctor blade for ensuring that only the engraved portions of the gravure printing plate contain ink.

SUMMARY OF THE INVENTION

The invention features a cup holder that automatically rotates a doctoring ink cup. The holder includes a housing with a cup receiving chamber and a bumper extending into the cup receiving chamber. The bumper contacts the ink cup to rotate it within the cup receiving chamber during inking of a gravure plate. It is the relative motion of the gravure plate and the ink cup during inking of the gravure plate which causes the bumper to contact the ink cup.

Preferred embodiments have a second bumper extending into the cup receiving chamber. A low friction contact, e.g., a bearing assembly, interfaces with the doctoring ink cup. Magnets mount the cup holder to the gravure plate in a pad printing machine.

According to another aspect of the invention, a cup assembly for inking a gravure plate includes a doctoring ink cup and a cup holder for rotating the doctoring ink cup.

A method of inking a gravure plate with a doctoring ink cup, according to the invention, includes inking the gravure plate by relative motion between the doctoring ink cup and the gravure plate, and rotating the ink cup during inking such that an edge of the ink cup in contact with the gravure plate rotates with respect to the gravure plate, the rotation being caused by the relative motion.

According to another aspect of the invention, a method of inking a gravure plate with a doctoring ink cup includes providing a cup holder for rotating the doctoring ink cup, and inking the gravure plate by relative motion between the doctoring ink cup and the gravure plate such that contact of the doctoring ink cup with the bumper causes rotation of the doctoring ink cup. Another advantage is that the ink cup and plate do no "WEAR" into each other, preventing interchangability with other plate and cup combinations.

The ink cup rotates without the need for additional moving parts beyond the ink cup and the gravure plate. Rotation of the ink cup helps provide even, i.e., flat, wear of the cup's plate contacting edge and the gravure plate by gradually exposing their surfaces to any high or uneven (non-flat) points of contact. This can extend the service life of the ink cup and the gravure plate, and permit interchanging of the ink cup and gravure plate with other ink cups and gravure plates since the ink cup and gravure plate do not "wear" into each other. Additionally, cup rotation provides good ink lubrication at the ink cup/gravure plate interface, resulting in lessened wear of the cup's plate contacting edge and further extension of the service life of the ink cup.

Other features and advantages will be apparent from the following description and from the claims.

DESCRIPTION OF THE PREFERRED EMBODIMENT

Figure 1:
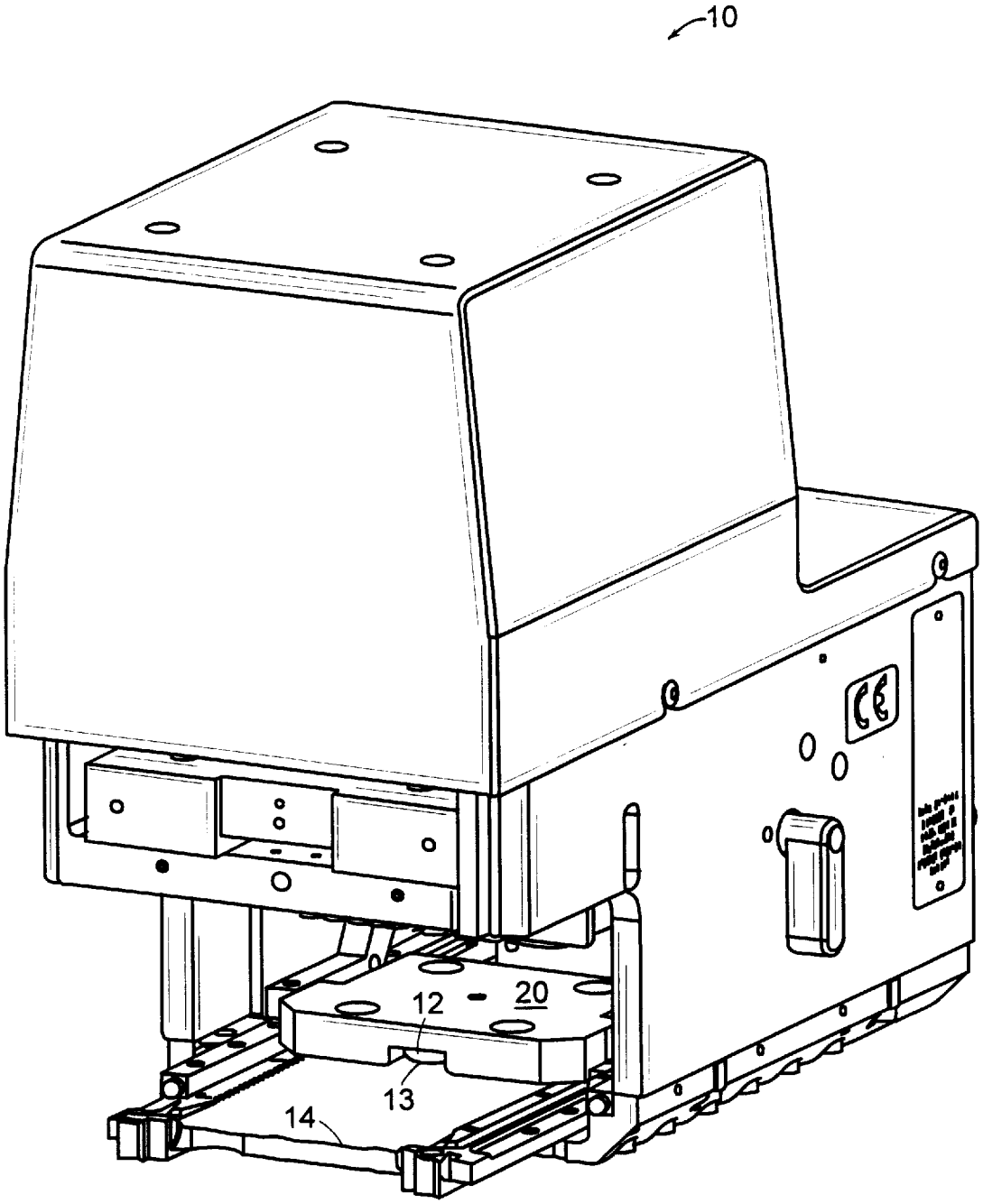
FIG. 1 is a schematic of a pad printing machine.

Referring to FIG. 1, a pad printing machine 10 includes a rotating doctoring cup 12 located within a cup holder 20 and positioned over a movable printing plate 14 engraved with a pattern to be printed. Doctoring cup 12 defines an ink well 17 (see FIG. 2) and has a plate contacting edge 13. To pick-up ink from plate 14 for transferring to an object to be printed (not shown), plate 14 moves from below cup 12 and a pad, not shown, is lowered onto the plate. Movement of plate 14 relative to plate contacting edge 13 removes excess ink from plate 14 so that contact of pad 15 with plate 14 transfers only the desired image to the pad.

Figure 2:
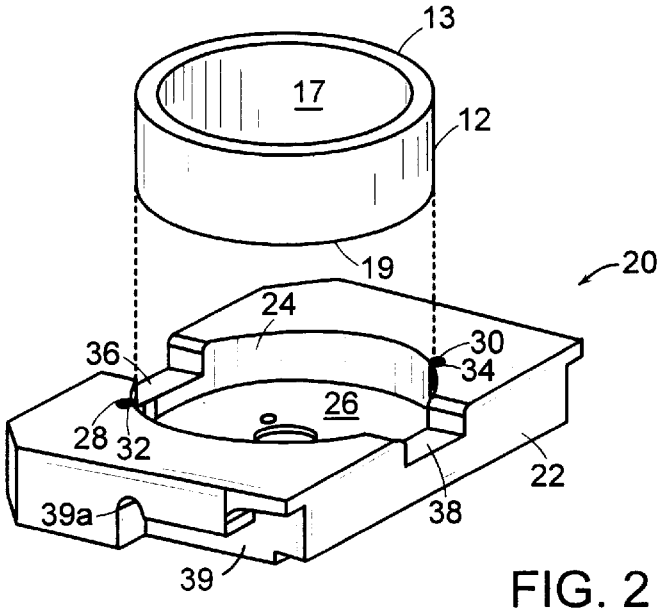
FIG. 2 is a schematic of a cup holder and a doctoring ink cup of the pad printing machine of FIG. 1.

Referring to FIG. 2, rotating doctoring cup 12 is located within a cup receiving chamber 26 of cup holder 20. A housing 22 of cup holder 20 has an inner wall 24 defining cup receiving chamber 26. A pair of bumpers 28, 30, made from, e.g., an elastomer such as nitrile rubber having a durometer of 60 Shore A, are located within passages 32, 34, respectively, in inner wall 24. Bumpers 28, 30 extend from passages 32, 34 into cup receiving chamber 26 such that the bumpers are in position to intermittently contact a doctoring cup 12 located in cup receiving chamber 26 to cause doctoring cup 12 to rotate, described further below. The term bumper is meant to include anything extending into cup receiving chamber 26 and causing ink cup 12 to rotate, as described further below. Housing 22 defines side notches 36, 38 which facilitate placement of cup 12 into cup receiving chamber 26.

Figure 3:
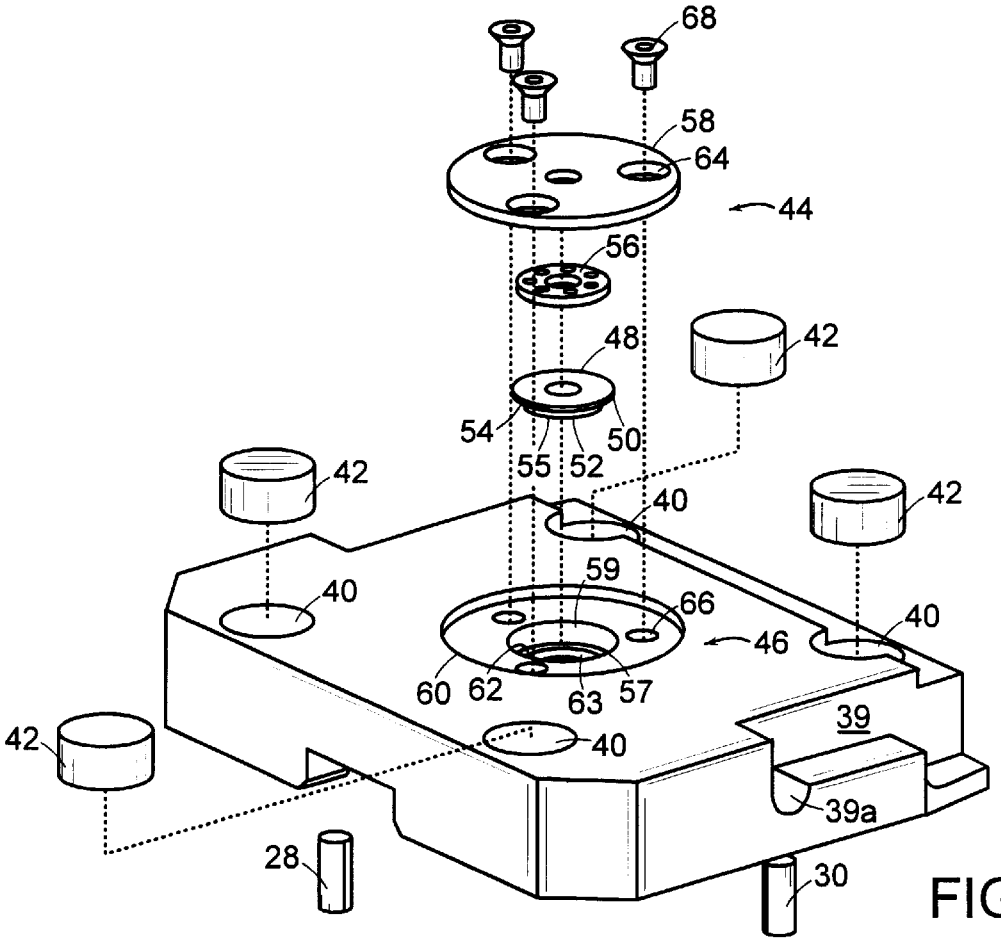
FIG. 3 is an exploded view of the cup holder of FIG. 2.

Referring to FIG. 3, cup holder 20 is shown with cup receiving chamber 26 facing downward, this being the position of cup holder 20 during use in pad printing machine 10. Housing 22 of cup holder 20 defines four holes 40 in which magnets 42 are placed. Magnets 42 attract plate 14 to cup holder 20 to hold cup 12 and plate 14 in contact during loading and unloading of the cup/plate assembly into and out of pad printing machine 10.

Cup holder 20 further includes a bearing assembly 44 which is mounted to housing 22 in a bearing mount 46. Bearing assembly 44 includes a cup contacting ring 48 having a first portion 50 of larger outer diameter than a second portion 52. The two portions 50, 52 define a shelf 54 therebetween that prevents the cup contacting ring (48) from falling out. Second portion 52 terminates in a cup contacting surface 55. Bearing assembly 44 further includes a bearing 56 and a mounting plate 58.

Bearing mount 46 in housing 22 is defined by a central hole 57 which receives cup contacting ring 48 and bearing 56, and a counterbore 60 which receives mounting plate 58. Housing 22 defines a larger diameter section 59 for receiving ring portion 50 and a smaller diameter through hole 63 for receiving ring portion 52. Sections 59 and through hole 63 define a ledge 62 therebetween which, together with shelf 54, prevent cup contacting ring from falling through through hole 63. To mount bearing assembly 44 to bearing mount 46, mounting plate 58 defines three holes 64 for receiving screws 68 and housing 22 defines three holes 66 for receiving screws 68.

With ink cup 12 positioned in chamber 26, a bottom surface 19 (see FIG. 2) of ink cup 12 contacts ring surface 55 and lifts ring 48 such that ring shelf 54 is not in contact with ledge 62. Bearing assembly 44 and bearing mount 46 are dimensioned such that ring 48 is free to rotate when ring surface 55 is in contact with bottom surface 15 of ink cup 12 to provide a low friction contact between cup holder 20 and ink cup 12. For example, portion 52 has a diameter of 0.4" and portion 54 has a diameter of 0.55", while section 59 has a diameter of 0.6" and through hole 63 has a diameter of 0.45". This "floating" bearing arrangement further acts to center a doctoring load applied to ink cup 12 to distribute the doctoring pressure evenly on gravure plate 14.

Figure 4:
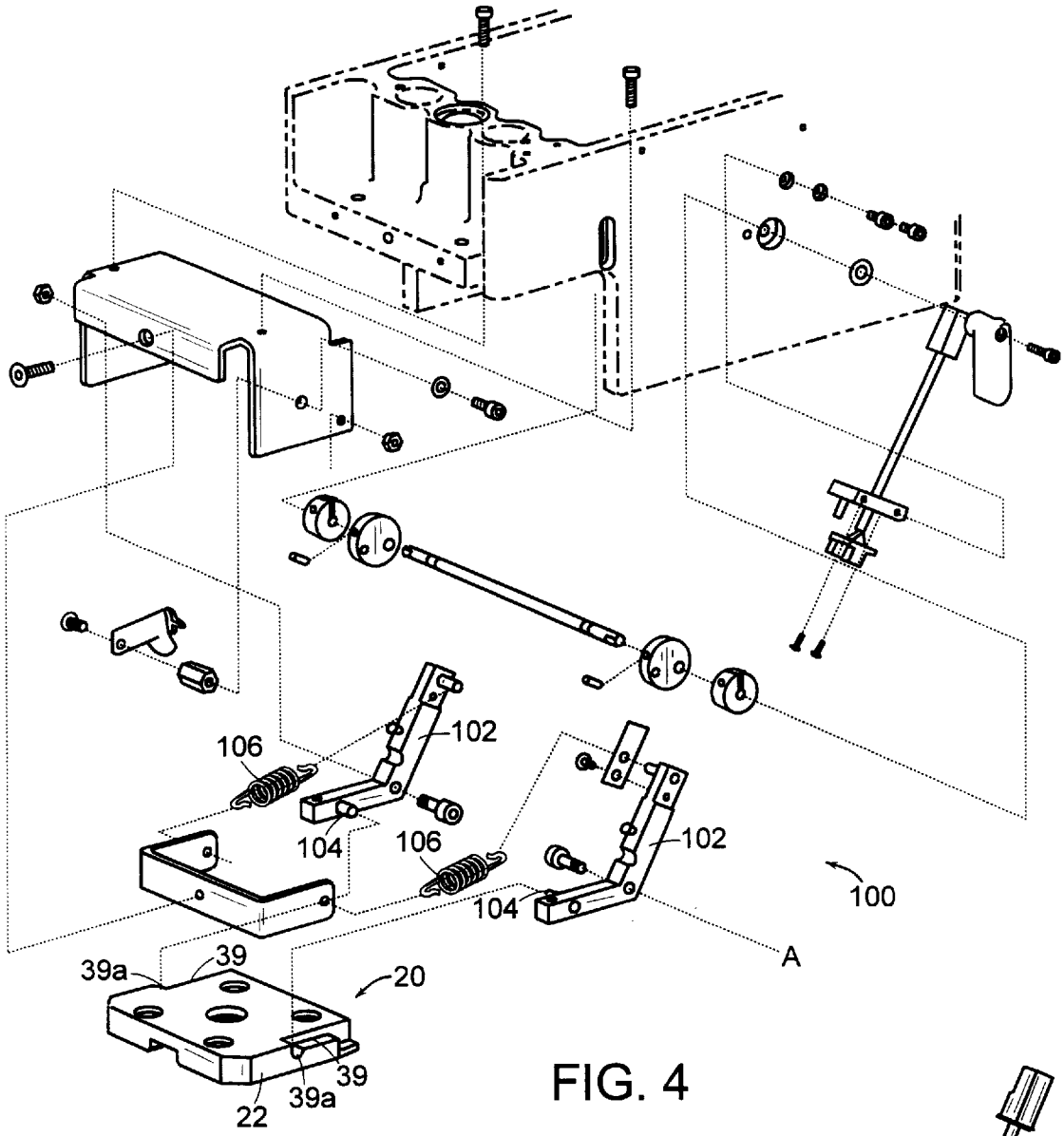
FIG. 4 is an exploded view of a mount assembly.
Figure 4A:
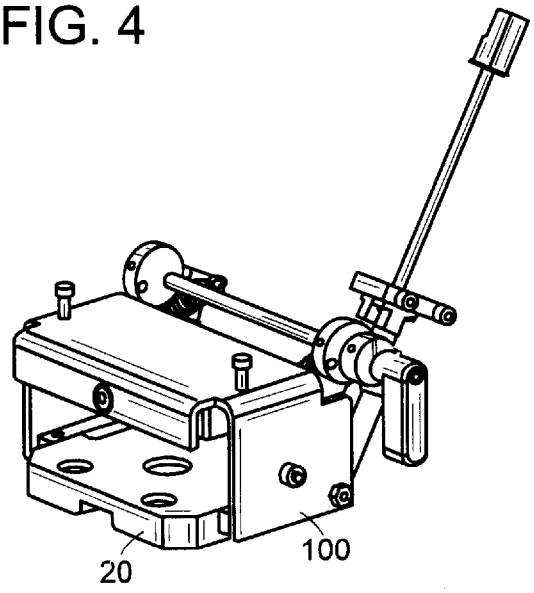
FIG. 4A shows the cup holder locating in the mount assembly of FIG. 4.

Referring also to FIG. 4, holder 20 is connected to pad printing machine 10 via a mount assembly 100. Mount assembly 100 includes links 102 with pins 104. Housing 22 includes clearance cuts 39 leading to radiused cuts 39*a*. Clearance cuts 39 allow pins 104 to slide into place in radiused cuts 39*a*. Springs 106 put tension on links 102 to apply a downward, doctoring force on cup holder 20 through pins 104 as links 102 pivot about axis, A. FIG. 4A shows holder 20 located in mount assembly 100.

Rotation of ink cup 12 can extend the service life of ink cup 12 and gravure plate 14. Cup rotation helps provide even, i.e., flat, wear of plate contacting edge 13 and gravure plate 14, and provides good ink lubrication at the ink cup/gravure plate interface. Without cup rotation, pigment in ink which gets caught along plate contacting edge 13, at the non-leading and trailing edges of the cup, polymerizes, building up on gravure plate 14 making the surface of the gravure plate uneven resulting in wear of the cup edge.

Figure 5:
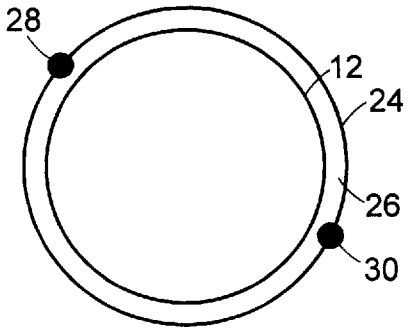
FIG. 5 is a diagrammatic illustration of the doctoring ink cup located within the cup holder.
Figure 5A:
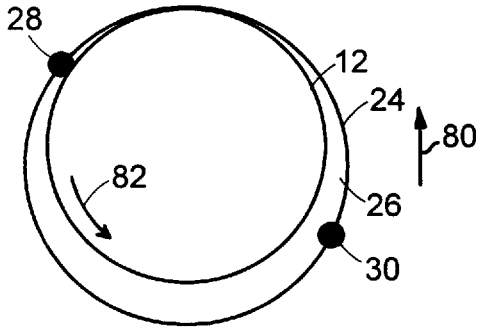
FIG. 5A is a diagrammatic illustration of the motion of the doctoring ink cup during inking of a gravure plate.
Figure 5B:
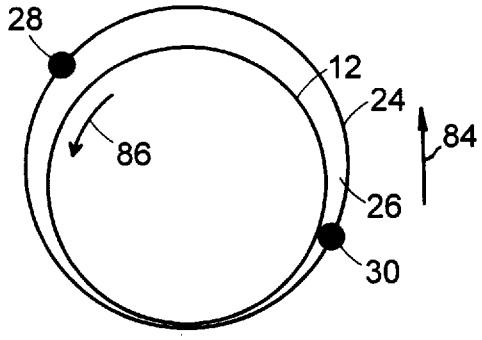
FIG. 5B is an additional diagrammatic illustration of the motion of the doctoring ink cup during inking of a gravure plate.

Referring to FIGS. 5–5B, in use, ink cup 12 is initially centered within chamber 26 defined by wall 24 of housing 22. Movement of gravure plate 14 causes bumpers 28, 30 to intermittently contact ink cup 12 causing ink cup 12 to rotate. When gravure plate 14 moves along a first direction, arrow 80, the movement of the plate causes the ink cup to also move along the first direction relative to housing 22 (FIG. 5A). This motion results in ink cup 12 contacting bumper 28 which causes ink cup 12 to slide off center and rotate in a counter-clockwise direction, arrow 82. When gravure plate 14 moves along a second direction, arrow 84, the movement of the plate causes the cup to move along the second direction relative to housing 22 (FIG. 5B). This motion results in cup 12 contacting bumper 30 which causes ink cup 12 to slide and further rotate in a counter-clockwise direction, arrow 86. Repeated back and forth motion of gravure plate 14 with respect to ink cup 12, or alternatively, repeated back and forth motion of ink cup 12 with respect to gravure plate 14, causes continuous rotation of ink cup 12.

The relative dimensions of ink cup 12 and cup receiving chamber 26 are selected to produce rotation of cup 12. For example, for a cup 12 having an outer diameter of 2.245", the diameter of cup receiving chamber 26 defined by wall 24 is 2.294".

Other embodiments are within the scope of the following claims.

What is claimed is:

1. A cup holder for rotating a doctoring ink cup, comprising:

a housing including a cup receiving chamber, and a bumper extending into said cup receiving chamber for contacting the doctoring ink cup to cause rotation of the doctoring ink cup within said cup receiving chamber during inking of a gravure plate.

2. The cup holder of claim 1 further including a second bumper extending into said cup receiving chamber for contacting the doctoring ink cup to cause rotation of the doctoring ink cup within said cup receiving chamber during inking of the gravure plate.

3. The cup holder of claim 1 wherein said bumper comprises an elastomer.

4. The cup holder of claim 1 further including a low friction contact for interfacing with the doctoring ink cup.

5. The cup holder of claim 4 wherein said low friction contact comprises a bearing assembly.

6. The cup holder of claim 1 further comprising magnets for mounting said cup holder to a pad printing machine.

7. A cup assembly for inking a gravure plate, comprising:

a doctoring ink cup, and a cup holder for rotating said doctoring ink cup including a housing with a cup receiving chamber, and a bumper extending into said cup receiving chamber for contacting said doctoring ink cup to cause rotation of said doctoring ink cup within said cup receiving chamber during inking of a gravure plate.

8. A method of inking a gravure plate with a doctoring ink cup, comprising:

inking said gravure plate by relative motion between said doctoring ink cup and said gravure plate, and rotating said ink cup during inking such that an edge of said ink cup in contact with said gravure plate rotates with respect to said gravure plate, said rotation being in response to the relative motion.

9. A method of inking a gravure plate with a doctoring ink cup, comprising:

providing a cup holder for rotating said doctoring ink cup, said cup holder including a housing including an inner wall defining a cup receiving chamber, and a bumper extending into said cup receiving chamber for contacting the doctoring ink cup, said bumper causing rotation of the doctoring ink cup within said cup receiving chamber during inking of a gravure plate, and inking said gravure plate by relative motion between said doctoring ink cup and said gravure plate such that contact of said doctoring ink cup with said bumper causes rotation of said doctoring ink cup.

* * * * *